US010080082B2

(12) United States Patent
Ganta et al.

(10) Patent No.: US 10,080,082 B2
(45) Date of Patent: Sep. 18, 2018

(54) MICROPHONE SYSTEM HAVING HIGH ACOUSTICAL OVERLOAD POINT

(71) Applicants: Akustica, Inc., Pittsburgh, PA (US); Robert Bosch GmbH, Stuttgart (DE)

(72) Inventors: Saikrishna Ganta, Milpitas, CA (US); Chinwuba Ezekwe, Albany, CA (US)

(73) Assignees: Akustica, Inc., Pittsburgh, PA (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/471,470

(22) Filed: Mar. 28, 2017

(65) Prior Publication Data

US 2018/0234762 A1 Aug. 16, 2018

Related U.S. Application Data

(60) Provisional application No. 62/459,813, filed on Feb. 16, 2017.

(51) Int. Cl.

| | |
|---|---|
| ***H04R 3/00*** | (2006.01) |
| ***H04R 3/02*** | (2006.01) |
| ***H04R 19/00*** | (2006.01) |
| ***H04R 19/04*** | (2006.01) |

(52) U.S. Cl.

CPC ..... *H04R 3/02* (2013.01); *H04R 19/005* (2013.01); *H04R 19/04* (2013.01); *H04R 2201/003* (2013.01); *H04R 2410/03* (2013.01)

(58) Field of Classification Search

None

See application file for complete search history.

(56) References Cited

U.S. PATENT DOCUMENTS

2004/0131210 A1* 7/2004 Kern ..... H03F 1/56 381/120

* cited by examiner

*Primary Examiner* — James Mooney

(74) *Attorney, Agent, or Firm* — Maginot Moore & Beck LLP

(57) ABSTRACT

A microphone biasing circuit comprises a microphone connected between a first node and a first DC bias voltage, the microphone configured to provide a sensed voltage at the first node in response to sound; a first diode and a second diode, the first diode and the second diode connected anti-parallel with one another between the first node and a second node, the second node having a second DC bias voltage; an amplifier having an input connected to the first node and an output connected to a third node, the amplifier configured to provide an output voltage to the third node based on the sensed voltage at the first node; and a feedback path connected from the third node to the second node. The feedback path comprises at least one element configured to couple alternating components of the output voltage at the third node to the second node.

20 Claims, 9 Drawing Sheets

MICROPHONE SYSTEM HAVING HIGH ACOUSTICAL OVERLOAD POINT

This application claims the benefit of priority of U.S. provisional application Ser. No. 62/459,813, filed on Feb. 16, 2017 the disclosure of which is herein incorporated by reference in its entirety.

FIELD

The devices disclosed in this document relate to microphone biasing circuits and, more particularly, to microphone biasing circuits having a high acoustical overload point.

BACKGROUND

Microphones are transducers that convert sound into an electrical signal. Microphones are used in a multitude of different applications, such as sound recording, telephones, hearing aids, and various sensor systems. Microphones generally operate most accurately within a particular range of sound levels, depending on a sensitivity and configuration of the microphone. In very loud sound environments, the output signal of the microphone will often become distorted. Particularly, essentially any microphone will have an acoustical overload point (AOP), which is a level of sound at which the microphone can no longer effectively distinguish between the actual sound signal and noise/distortion. For example, the AOP may be defined as the sound pressure level at which distortion in the output signal reaches 10%.

Some types of microphones, such as condenser microphones and capacitive MEMS (microelectromechanical systems) microphones, require a DC bias voltage in order to operate. MEMS microphones additionally require a very high resistance to establish proper DC biasing. This resistance is on the order of few 100's of Giga Ohms.

FIG. 1*a* shows a microphone circuit 1 for biasing a MEMS microphone 10. The microphone circuit 1 includes charge pump 5 that provides a DC bias voltage for the microphone 10. The circuit 1 includes diodes 25 and 35 which are coupled antiparallel to one another between the charge pump 5 and a node 50. A capacitor 60 is connected between the node 50 and ground. The microphone 10 is connected between the node 50 and a node 40. The microphone 10 modulates the voltage at the node 40 to provide a sensed voltage in response to sound. The circuit 1 further includes diodes 20 and 30 which are coupled antiparallel to one another between the node 40 and ground. Finally, the circuit 1 includes a pre-amplifier 70 having an input connected to the node 40, which provides an output signal at an output node 80 based on the sensed voltage.

One disadvantage of the circuit 1 is that the sensed voltage at the node 40 often has an undesired DC offset. Particularly, due to parasitic resistance $R_{parasitic}$ of the microphone 10, a small leakage current flows from the node 50 to the node 40, through the microphone 10. The leakage current then flows from the node 40 to ground, through the diodes 20, 30. As a result of the leakage current, the sensed voltage may have a shifted DC offset. For example, the DC offset for the sensed voltage may shift slightly by approximately 300 mV.

Another disadvantage of the circuit 1 is that, at high signal levels, the diodes 20, 30 will clip the sensed voltage, which greatly reduces the AOP of the circuit. Particularly, each of the diodes 20, 30 has a forward voltage $V_F$ (e.g., 700 mV) at which it will turn on. At high signal levels, the diodes 20, 30 start to turn on, which distorts the sensed voltage. When the sensed voltage falls below $-V_F$, the diode 20 will turn on and clip the sensed voltage. Similarly, when the sensed voltage rises above $+V_F$, then the diode 30 will turn on and clip the sensed voltage.

FIG. 1*b* shows an exemplary waveform 90 for the sensed voltage at the node 40 of the circuit 1 in response to microphone 10 being subjected to a high SPL 20 Hz acoustical signal. As can be seen, the waveform 90 is distorted (clipped) when the signal level is too high, due to the diodes 20, 30 being turned on. As is apparent, this clipping effect caused by the turning on of the diodes 20, 30 greatly limits the AOP of the microphone circuit 1. FIG. 2 shows a plot illustrating a frequency spectrum 95 of the waveform 90. As can be seen, the frequency spectrum 95 includes a spike at 20 Hz, which corresponds to the actual sound (i.e. the 20 Hz acoustical signal). However, as can also be seen, the frequency spectrum 95 further includes additional large spikes at 40 Hz, 60 Hz, 80 Hz, 100 Hz, 120 Hz, 140 Hz, and 180 Hz, which correspond to the distortion introduced by the turning on of the diodes 20, 30. As is apparent, this clipping effect caused by the turning on of the diodes 20, 30 greatly limits the AOP of the microphone circuit 1.

One configuration that can reduce the distortion effect includes arranging series stacks of the diodes 20, 30 to provide more headroom for the sensed voltage. This modification increases the AOP of the microphone circuit, but has disadvantages. Particularly, this configuration provides reduced effectiveness at higher temperatures (due to a reduction of forward voltage $V_F$ at higher temperatures) and may cause tones in the output signal at normal operation. Another configuration that can increases the AOP of the microphone circuit includes a microphone 10 that is configured with reduced sensitivity. The circuit employs electronic gain to compensate for the reduced sensitivity of the microphone. However, this configuration has the disadvantage of consuming more power. A further configuration that can increase the AOP of the microphone circuit is one in which the gain of the microphone is reduced when high sound levels are detected. However, this configuration has the disadvantage of creating acoustical artifacts, such as clicks and pops, in the output signal. Yet another configuration that can increase the AOP of the microphone circuit is one in which the microphone has multiple membranes with differing sensitivity. The circuit switches between multiple membranes depending on sound levels. However, this configuration also has the disadvantage of creating acoustical artifacts in the output signal.

Accordingly, what is needed is a microphone biasing circuit that achieves a high AOP with high energy efficiency and without introducing acoustical artifacts into the output signal.

SUMMARY

A microphone biasing circuit is disclosed. The microphone biasing circuit comprises a microphone having a first terminal connected to a first node and a second terminal connected to a first DC bias voltage, the microphone being configured to provide a sensed voltage at the first node in response to sound; a first diode and a second diode, each connected between the first node and a second node, the first diode and the second diode being connected antiparallel with one another, the second node having a second DC bias voltage that is coupled to the first node via the first diode and the second diode; a first amplifier having an input connected to the first node and an output connected to a third node, the first amplifier being configured to provide an output voltage to the third node based on the sensed voltage at the first node; and a first feedback path connected from the third node to the second node. The first feedback path comprises at least one element arranged in the first feedback path and configured to couple alternating components of the output voltage at the third node to the second node.

BRIEF DESCRIPTION OF THE DRAWINGS

The foregoing aspects and other features of a microphone circuit are explained in the following description, taken in connection with the accompanying drawings.

DETAILED DESCRIPTION

Figure 1A:
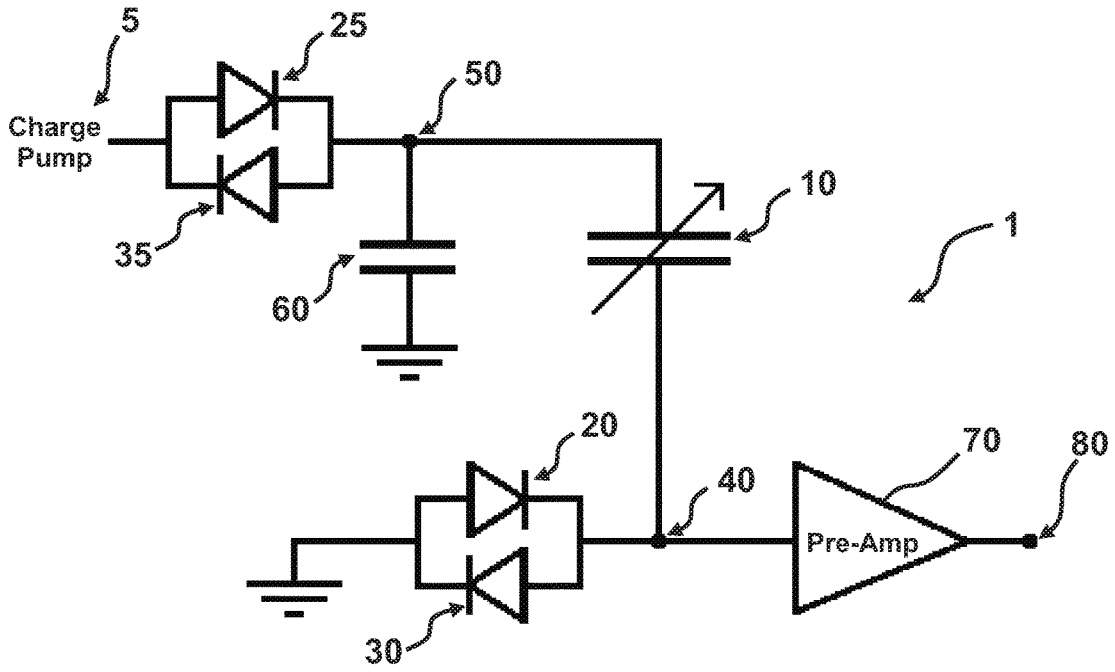
FIG. 1a (PRIOR ART)
FIG. 1*a* shows a microphone circuit according to the prior art.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art which this disclosure pertains.

Figure 3A:
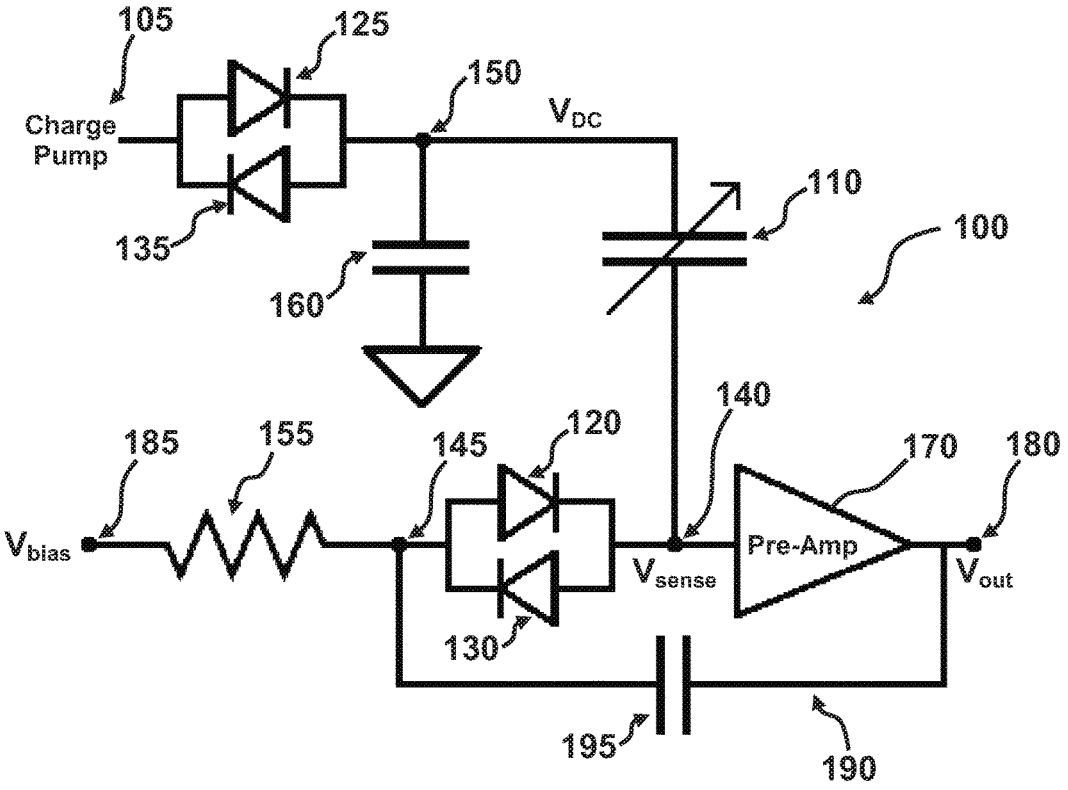
FIG. 3*a* shows a microphone circuit that utilizes energy efficient antiparallel diode biasing but also has a high AOP.

FIG. 3*a* shows a microphone circuit 100 that advantageously utilizes energy efficient diode biasing but also has a high AOP. It is noted that, although the circuit 100 is shown and described in a single-ended form, in some embodiments, the circuit 100 is in a differential form. The microphone circuit 100 includes a microphone 110 connected between a node 150 and a node 140. The microphone 110 is configured to modulate the voltage at the node 140 to provide a sensed voltage $V_{sense}$ in response to sound. In at least one embodiment, the microphone 110 is a MEMS (microelectromechanical systems) microphone. In some embodiments, some or all of the components of the microphone circuits described herein are integrated together on a single chip with the MEMS microphone. In many embodiments, the operating principle of the microphone 110 is that of a capacitive sensor having at least one electrically conductive membrane, diaphragm, or the like that is mechanically responsive to sound waves. In the illustrations provided herein, the microphone 110 is depicted schematically as a variable capacitor.

The microphone circuit 100 includes a charge pump 105 configured to provide a predetermined DC bias voltage $V_{DC}$. The circuit 100 includes diodes 125 and 135 which are coupled antiparallel to one another between the charge pump 105 and a node 150. The diodes 125 and 135 operate to couple the predetermined DC bias voltage $V_{DC}$ from the charge pump 105 to the node 150. In one embodiment, the predetermined DC bias voltage $V_{DC}$ is 20 V. A capacitor 160 is connected between the node 150 and a fixed common voltage, which may be ground.

The circuit 100 includes diodes 120 and 130 which are coupled antiparallel to one another between a node 145 and the node 140. The diodes 120 and 130 operate to couple a DC voltage at the node 145 to the node 140. The circuit 100 further includes a pre-amplifier 170 having an input connected to the node 140 and configured to provide an output signal $V_{out}$ at an output node 180 based on the sensed voltage $V_{sense}$ at the node 140. In one embodiment, the pre-amplifier 170 operates as a voltage buffer having unity gain, high input impedance, and low output impedance.

The circuit 100 avoids the problem of signal clipping at high signal levels by ensuring that the diodes 120, 130 do not experience any substantial voltage across their terminals. To accomplish this, the circuit 100 includes a feedback path 190 connected between from the output node 180 to the node 145. In one embodiment, the feedback path 190 includes a capacitor 195 configured to couple the alternating components of the output voltage $V_{out}$ at the output node 180 to the node 145. In other embodiments, the feedback path 190 may include some other kind of high-pass or band-pass filter configured to couple the relevant alternating components of the output voltage $V_{out}$ to the node 145. In this way, the alternating voltages at the node 145 will mirror the alternating voltages induced by the microphone 110 at the node 140. Accordingly, the AC voltage difference across the diodes 120, 130 is essentially zero. As a result, the diodes 120, 130 do not turn on and, therefore, do not distort the sensed voltage $V_{sense}$ at the node 140.

In one embodiment, the feedback path 190 further includes a capacitance multiplier (not shown) configured to make the capacitor 190 function like a larger capacitor. The capacitor 190 in combination with the capacitance multiplier can essentially operate as a capacitance and can simply by modeled as a capacitance. In one embodiment, the capacitance multiplier is an active circuit comprising a transistor or operational amplifier, a supply voltage, and resistors arranged in a known manner.

Finally, the circuit 100 includes a resistance 155 connected between a node 185 and the node 145. The node 185 is connected to a corrective DC bias voltage $V_{bias}$. The value of the DC bias voltage $V_{bias}$ at the node 185 can be selected to counteract the undesired DC shift from the desired DC bias point at the node 140 due to leakage currents (e.g, $V_{bias}$ may be selected as −300 mV). In some embodiments, the desired DC bias point at the node 140 depends on the type of pre-amplifier 170 that is used. For example, the desired DC bias point at the node 140 may be 0 V or may be a supply voltage level of the pre-amplifier 170, such as 1.8 V.

Figure 4:
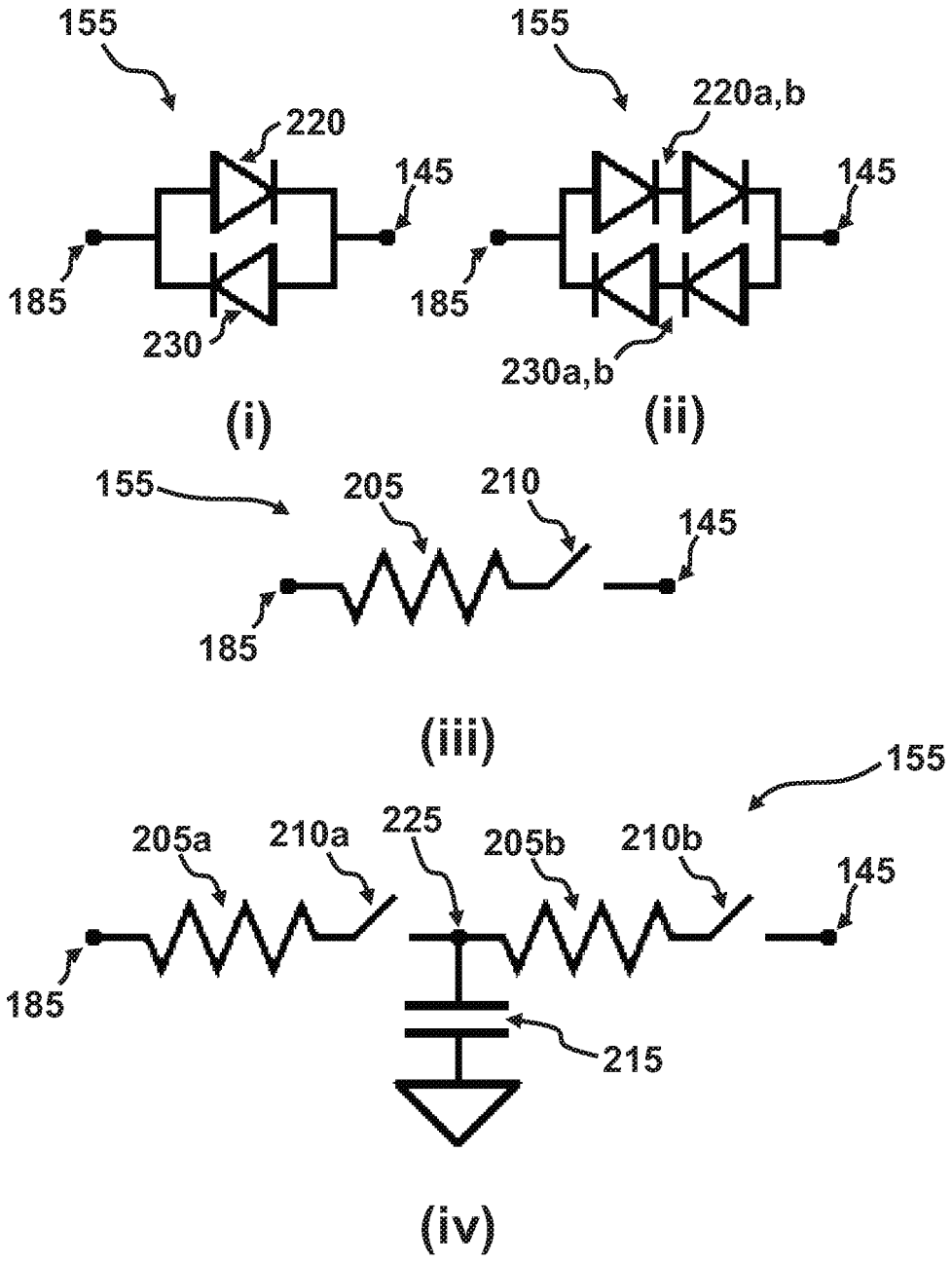
FIG. 4 shows the resistance of microphone circuit of FIG. 3*a* implemented in different ways.

In some embodiments, the resistance 155 is simply implemented by a linear resistor. However, the resistance 155 generally must have a very high resistance and a sufficient linear resistor may be quite large. FIG. 4 shows a few possible implementations of the resistance 155 that reduce noise, improve performance, and reduce physical size. In the embodiment (i), the resistance 155 is implemented by diodes 220, 230 which are coupled antiparallel to one another between the node 185 and the node 145. The diodes 220 and 220 operate to couple the DC bias voltage $V_{bias}$ from the node 185 to the node 145. In the embodiment (ii), the resistance 155 is implemented by stacked diodes 220*a-b* connected antiparallel with stacked diodes 230*a-b* between the node 185 and the node 145. The diodes 220*a-b*, 230*a-b* operate to couple the DC bias voltage $V_{bias}$ from the node 185 to the node 145. In the embodiment (iii), the resistance 155 is implemented as a linear resistor 205 connected in series with a switch 210. The switch 210 is opened and closed using a clock signal. A duty cycle of the clock signal can be adjusted to control the effective resistance of the resistance 155. Finally, in the embodiment (iv), the resistance 155 is implemented cascaded series connection of resistors 205*a-b* and switches 210*a-b*. A capacitor 215 is connected from a node 225, between the switch 210*a* and the resistor 205*b*, and a fixed common voltage, which may be ground. The resistors 205*a*, switch 210*a* and the capacitor 215 essentially form a low pass filter, such as an anti-aliasing filter. The switches 210*a-b* are opened and closed using clocks signals. Duty cycles of the clock signals can be adjusted to control the effective impedance of the resistance 155.

Figure 1B:
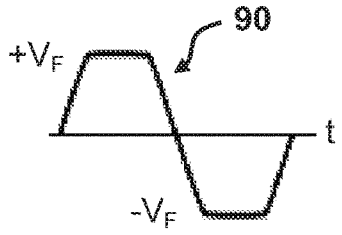
FIG. 1b (PRIOR ART)
FIG. 1*b* shows a plot illustrating an exemplary signal sensed by the microphone of FIG. 1*a* in response to a high SPL acoustical signal.
Figure 2:
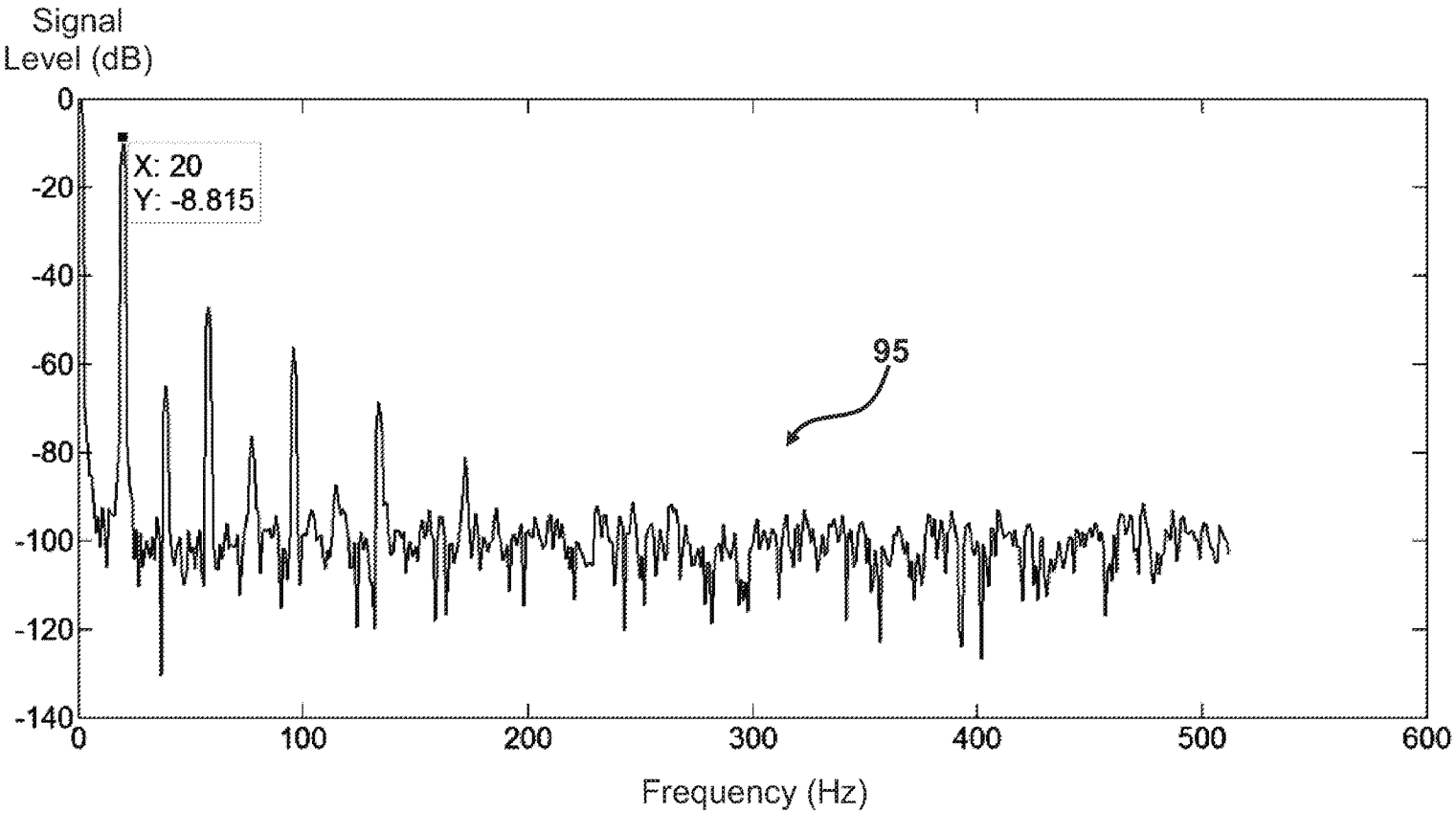
FIG. 2 (PRIOR ART)
FIG. 2 shows a plot illustrating a frequency spectrum of the waveform of FIG. 1*b*.
Figure 3B:
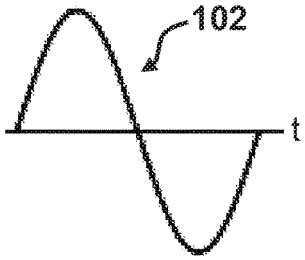
FIG. 3*b* shows a plot illustrating an exemplary waveform sensed by the microphone of FIG. 3*a* in response to a high SPL acoustical signal.
Figure 5:
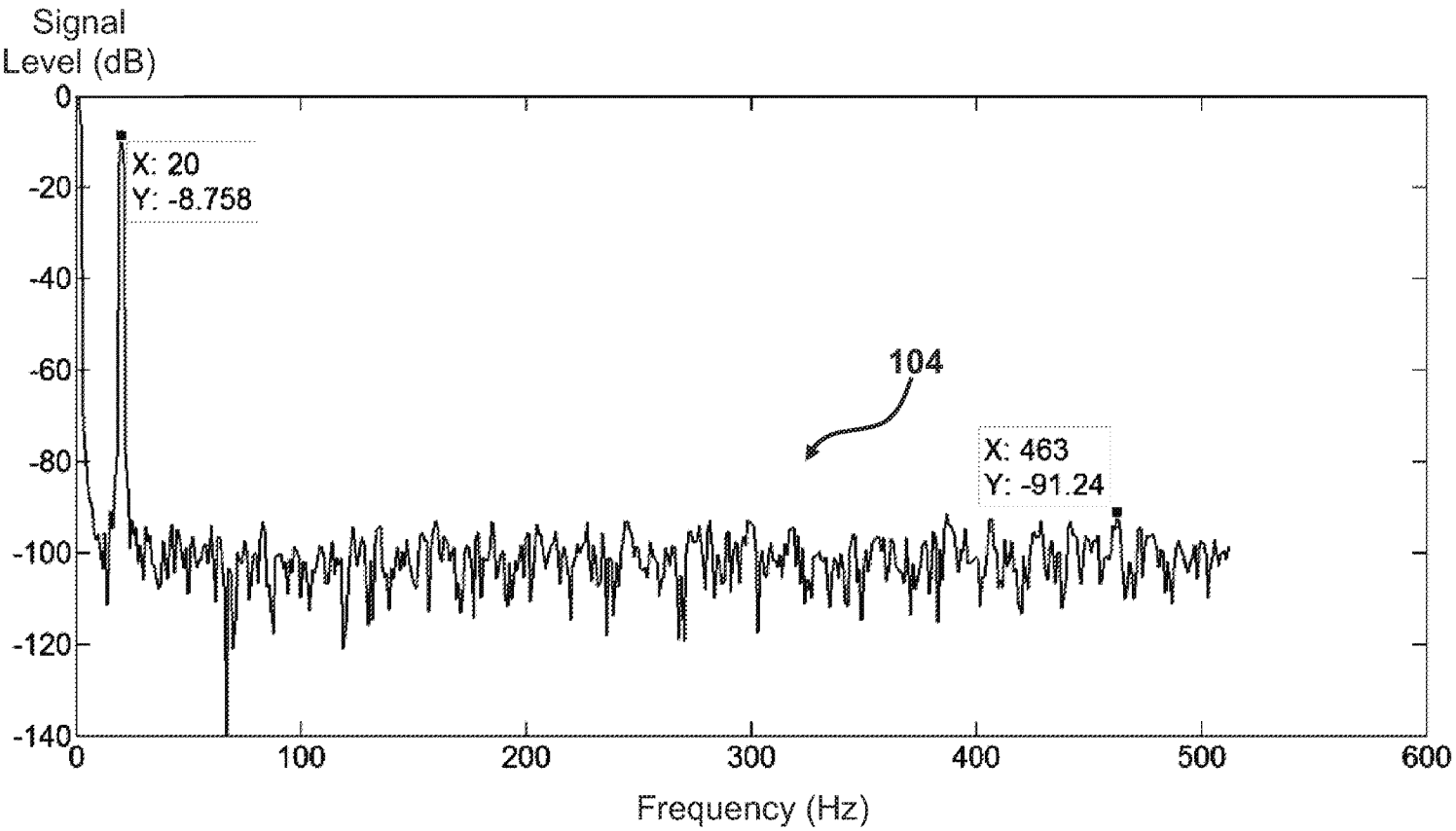
FIG. 5 shows a plot illustrating a frequency spectrum of the waveform of FIG. 3*b*.

FIG. 3*b* shows an exemplary waveform 102 for the sensed voltage $V_{sense}$ at the node 140 of the circuit 100 in response to microphone 110 being subjected to a high SPL 20 Hz acoustical signal. As can be seen, unlike the waveform 90 of FIG. 1*b*, the waveform 102 is not distorted at high signal levels. This waveform 102 is passed through the pre-amplifier 170 and coupled back to the node 145 via the capacitor 195. As result, both of the nodes 140 and 145 experience similar alternative voltages and the diodes 120, 130 are not turned on. FIG. 5 shows a plot illustrating a frequency spectrum 104 of the waveform 102. As can be seen, the frequency spectrum 104 includes a spike at 20 Hz, which corresponds to the actual sound (i.e. the 20 Hz acoustical signal). However, unlike the frequency spectrum 95 of FIG. 2, the frequency spectrum 102 does not include any additional large spikes corresponding to the distortion. Instead, the signal noise/distortion is below −90 dB for all unwanted frequencies. As is apparent, the microphone circuit 100 has a greatly improved AOP as compared to the microphone circuit 1.

Figure 6:
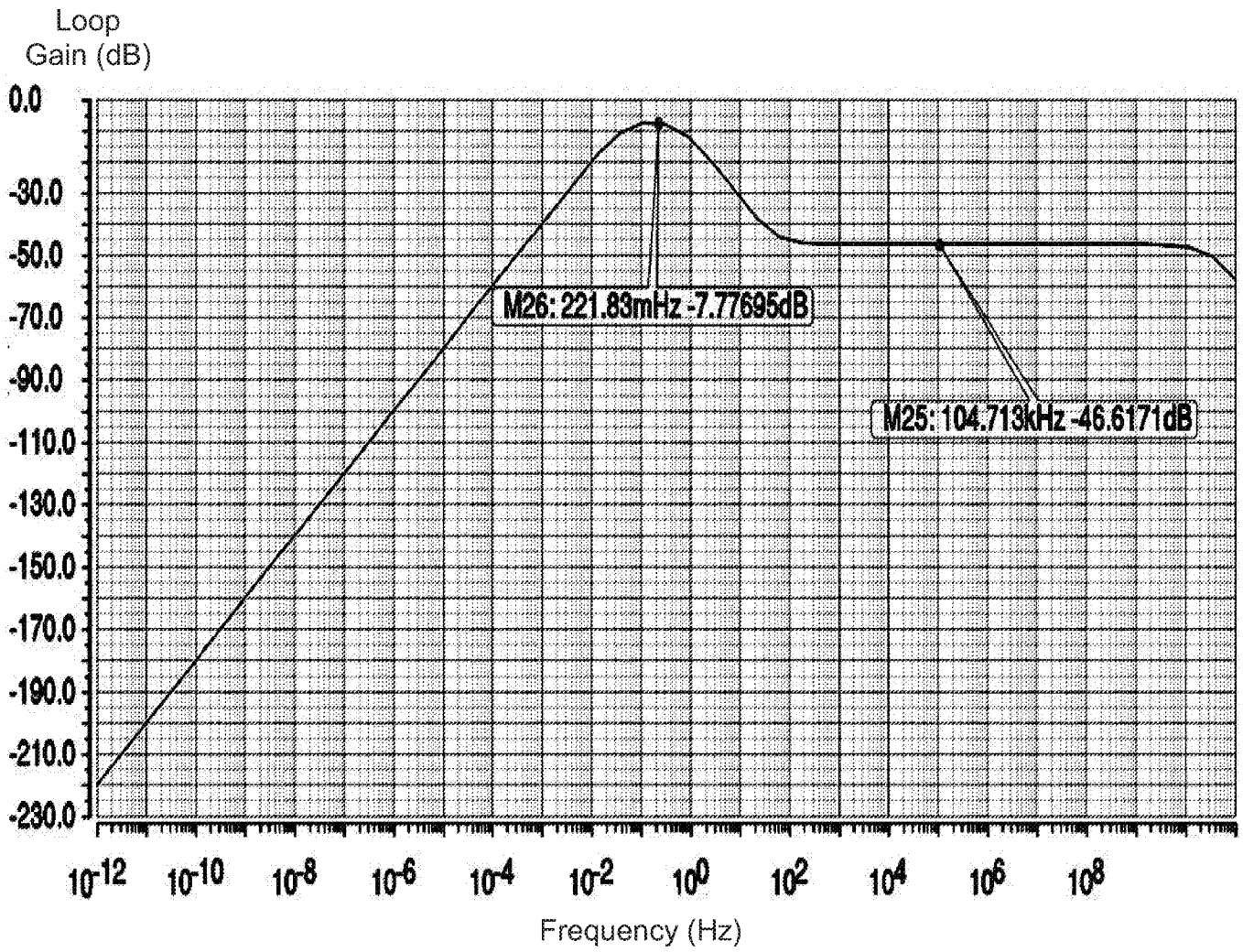
FIG. 6 shows a plot illustrating the loop stability response of the microphone circuit of FIG. 3*a*.

FIG. 6 shows a plot illustrating the loop stability response of the microphone circuit 100. As can be seen, at frequencies of interest (i.e. audible frequencies in a range between approximately 20 Hz to 20 KHz), the circuit 100 produces high attenuation. Accordingly, the loop noise is negligible.

In practical implementations of the microphone circuits described herein, the sensed voltage $V_{sense}$ at the node 140, which is input into the pre-amplifier 170, may be DC shifted slightly from a desired DC bias point to leakage currents flowing through the microphone 110 and/or the diodes 120, 130. The DC bias voltage $V_{bias}$ can be selected to counteract the undesired DC shift at the node 140. In some embodiments, the DC bias voltage $V_{bias}$ is provided by means of an offset correction feedback loop.

Figure 7:
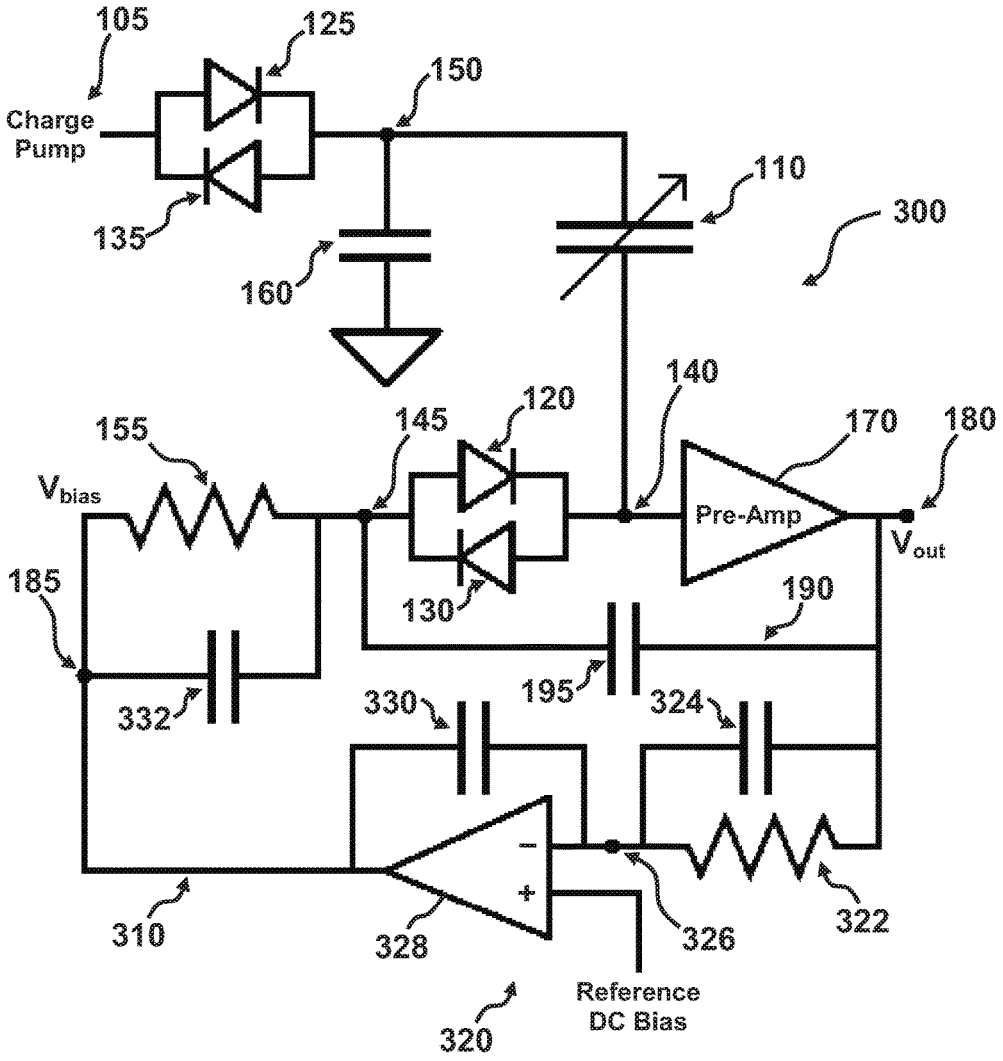
FIG. 7 shows a microphone circuit that includes an analog offset correction feedback loop.

FIG. 7 shows a microphone circuit 300 that includes an analog offset correction feedback loop. It is noted that, although the circuit 300 is shown and described in a single-ended form, in some embodiments, the circuit 300 is in a differential form. The circuit 300 is similar to the circuit 100 shown in FIG. 3*a* and like elements are identified to with common reference labels and not described again in detail. In addition to the components of the circuit 100, the circuit 300 further includes a feedback path 310 connected between the output node 180 and an input node 185. The feedback path 310 includes an analog offset correction circuit 320 configured to adjust or correct the DC offset present in the sensed voltage $V_{sense}$ at the node 140, such that it is equal to a desired DC bias point. In some embodiments, the desired DC bias point for the sensed voltage $V_{sense}$ depends on the type of pre-amplifier 170 that is used. In at least one embodiment, the desired DC bias point is equal to zero. In another embodiment, the desired DC bias point is equal to a supply voltage for the pre-amplifier 170, such as 1.8 V.

In some embodiments, the offset correction circuit 320 includes an integrator circuit and/or a low pass filter circuit. In the embodiment shown, the offset correction circuit 320 includes a resistor 322 and a capacitor 324 connected in parallel with one another between the output node 180 and a node 326. The node 326 is connected to an inverting input of an operational amplifier 328 of the offset correction circuit 320. A non-inverting input of the operational amplifier 328 is connected to a target voltage representing the desired DC bias point. The output of the operational amplifier 328 is connected to the input node 185. The offset correction circuit 320 further includes a capacitor 330 connected between the output of the operational amplifier 328 and the inverting input of the operational amplifier 328. Finally, a capacitor 332 is connected between the input node 185 and the node 145, in parallel with the resistance 155.

Figure 8:
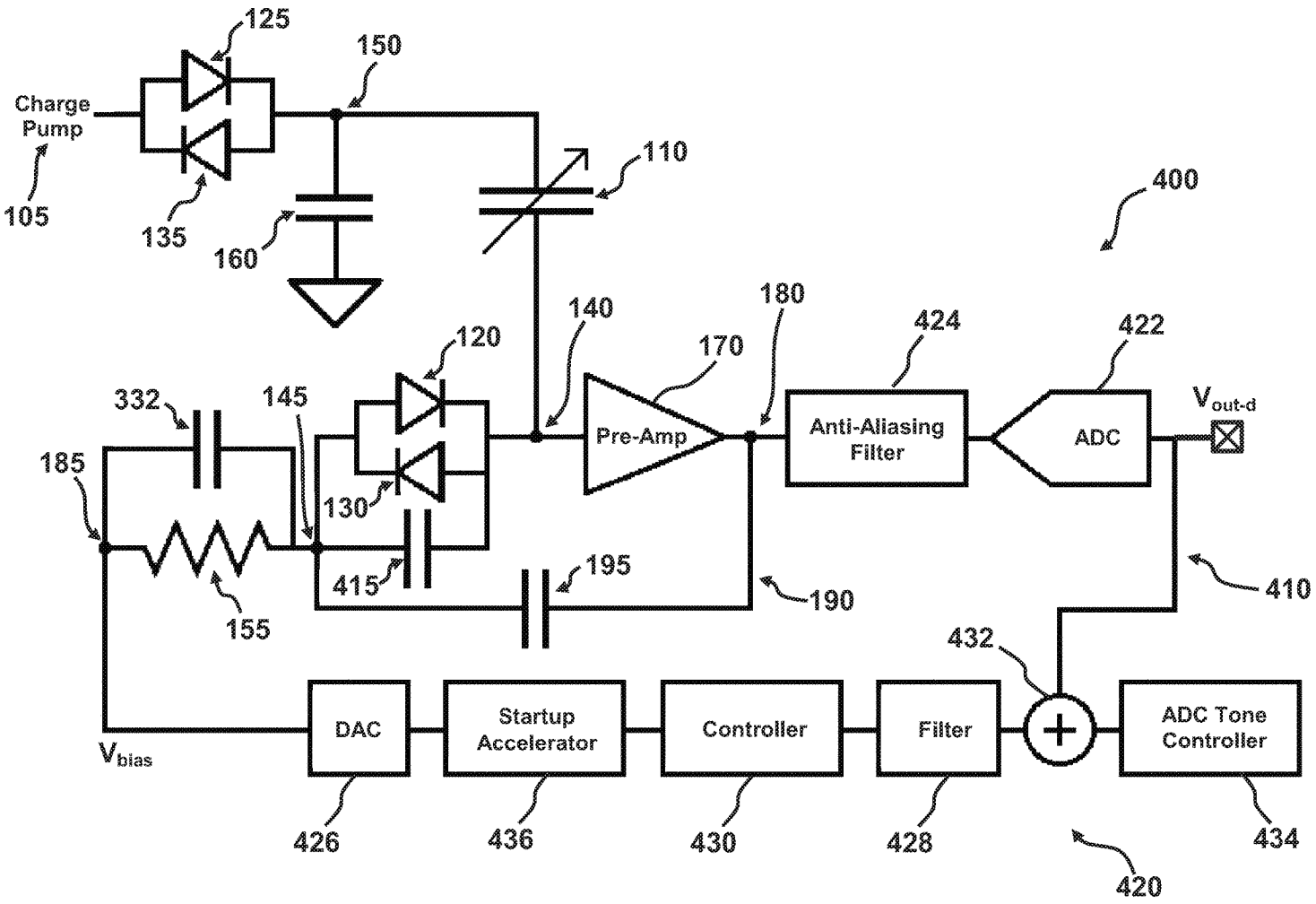
FIG. 8 shows a microphone circuit that includes a digital offset correction feedback loop.

FIG. 8 shows a microphone circuit 400 that includes a digital offset correction feedback loop, which is analogous to the analog offset correction feedback loop of the circuit 300. It is noted that, although the circuit 400 is shown and described in a single-ended form, in some embodiments, the circuit 400 is in a differential form. The circuit 400 is similar to the circuit 100 shown in FIG. 3*a* and like elements are identified to with common reference labels and not described again in detail. In addition to the components of the circuit 100, the circuit 400 further includes a digital feedback path 410 connected between the output node 180 and the node 145. Additionally, the capacitor 332 is connected between the input node 185 and the node 145, in parallel with the resistance 155 and a capacitor 415 is connected between the node 145 and the node 140, in parallel with the diodes 120, 130. The digital feedback path 410 includes a digital offset correction circuit 420 configured to adjust or correct the DC offset present in the sensed voltage $V_{sense}$ at the node 140, such that it is equal to a desired DC bias point. In some embodiments, the desired DC bias point for the sensed voltage $V_{sense}$ depends on the type of pre-amplifier 170 that is used. In at least one embodiment, the desired DC bias point is equal to zero. In another embodiment, the desired DC bias point is equal to a supply voltage for the pre-amplifier 170, such as 1.8 V.

The offset correction circuit 420 includes an analog-to-digital converter (ADC) 422 connected to the output node 180 and configured to digitize the output signal at the output node 180 to provide a digital feedback signal. The offset correction circuit 420 further includes a digital-to-analog converter (DAC) 426 connected to the node 185 and configured to convert the digital feedback signal back to an analog voltage for biasing the microphone 110. In one embodiment, the ADC 422 provides a digital output $V_{out\text{-}d}$. In one embodiment, the ADC 422 is a delta-sigma based converter, which may comprise a delta-sigma modulator and a digital filter. In one embodiment, the DAC 426 is a delta-sigma based converter, which may comprise a delta-sigma modulator and an analog filter.

In one embodiment, the offset correction circuit 420 includes an anti-aliasing filter 424 is connected between the output node 180 and the ADC 422. The anti-aliasing filter 424 is configured constrain the bandwidth of the output signal to prevent aliasing when digitized by the ADC 422. Particularly, the anti-aliasing filter 424 is at least configured to remove or attenuate alternating components from the output signal that have frequencies greater than half the sampling rate of the ADC 422.

The offset correction circuit 420 includes at least one digital filter 428 connected between the output of the ADC 422 and the input of the DAC 426. The digital filter 428 is configured to adjust or correct the DC offset present in the sensed voltage $V_{sense}$ at the node 140, such that it is equal to a desired DC bias point. In one embodiment, the digital filter 428 includes an integration path and a proportional path. In some embodiments, the desired DC bias point for the sensed voltage $V_{sense}$ depends on the type of pre-amplifier 170 that is used. In at least one embodiment, the desired DC bias point is equal to zero. In another embodiment, the desired DC bias point is equal to a supply voltage for the pre-amplifier 170, such as 1.8 V.

In one embodiment, the offset correction circuit 420 further includes a digital controller 430 is connected between the output of digital filter 428 and the input of the DAC 426. In one embodiment, the controller 430 is configured to measure operating points and other performance metrics for the digital feedback loop. In one embodiment, the controller 430 serves to stabilize the feedback loop and is configured to adjust or correct the DC offset present in the sensed voltage $V_{sense}$ at the node 140, such that it is equal to a desired DC bias point. In one embodiment, the controller 430 is configured to operate in conjunction with the digital filter 428 to correct the DC offset.

In some embodiments having a delta-sigma based ADC 422 and/or DAC 426, the distortion performance of the ADC 422 and/or DAC 426 can be affected by the DC offset in the signal at the output node 180. In one embodiment, the offset correction circuit 420 further includes an adder element 432 is connected between the output of the ADC 422 and the input of the DAC 426. In one embodiment, the adder element 432 is connected between output of the ADC 422 and the input of the digital filter 428. In another embodiment, the adder element 432 is connected between output of the digital filter 428 and the input of the DAC 426. The adder element 432 is connected to an ADC tone controller 434 and configured to inject an output signal from the ADC tone controller 434 into the digital feedback signal prior to processing by the digital filter 428. The ADC tone controller 434 is configured to provide an offset signal that reduces a distortion in the ADC 422 and/or DAC 426.

In one embodiment, the offset correction circuit 420 further includes a startup accelerator 436 connected between the DAC 426 and the controller 430 and/or the digital filter 428. The startup accelerator 436 is configured to store predefined or measured startup values for digital feedback signal in memory, which serve as initial conditions during startup of the digital feedback loop. In this way, the digital feedback loop is able startup faster.

Figure 9:
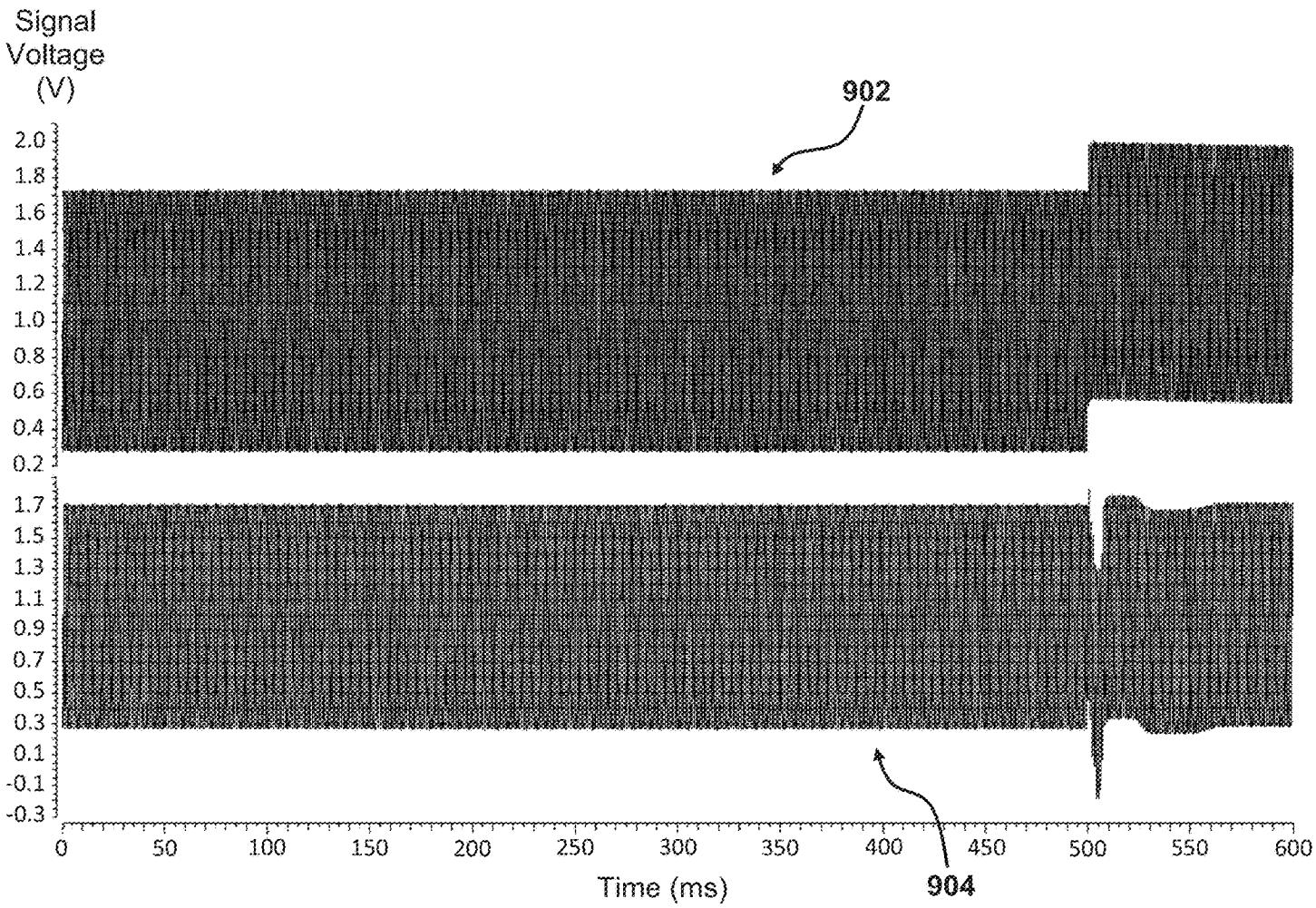
FIG. 9 shows a plot illustrating the transient performance of the microphone circuit with and without a DC offset correction loop.

FIG. 9 shows a plot illustrating the transient performance of the microphone circuit with and without a DC offset correction loop. Particularly, the plot illustrates the transient response of the DC offset correction loop to a disturbance at t=500 ms. The plot illustrates a waveform 902 of the microphone circuit without the DC offset correction loop. The plot further illustrates a waveform 904 of the microphone circuit without the DC offset correction loop. As can be seen in the waveform 902, the disturbance causes a DC shift of ~0.2 V, which decays very slowly. However, as can be seen in the waveform 904, in response to the disturbance, the DC offset correction loop stabilizes and corrects the DC offset, returning to the desired DC bias point of about 1 V within about 70 ms.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A microphone biasing circuit comprising:

a microphone having a first terminal connected to a first node and a second terminal connected to a first DC bias voltage, the microphone being configured to provide a sensed voltage at the first node in response to sound;

a first diode and a second diode, each connected between the first node and a second node, the first diode and the second diode being connected antiparallel with one another, the second node having a second DC bias voltage that is coupled to the first node via the first diode and the second diode;

a first amplifier having an input connected to the first node and an output connected to a third node, the first amplifier being configured to provide an output voltage to the third node based on the sensed voltage at the first node;

a resistance connected between the second node and a fourth node;

a first feedback path connected from the third node to the second node, the first feedback path comprising:

at least one element arranged in the first feedback path and configured to couple alternating components of the output voltage at the third node to the second node; and a second feedback path connected from the third node to the fourth node, the second feedback path comprising:

an offset correction circuit arranged in the second feedback path and configured to adjust a DC offset of the sensed voltage at the first node to have a predetermined magnitude.

2. The microphone biasing circuit of claim 1, the resistance comprising:

a switch connected in series with a resistor between the second node and the fourth node, the switch being operated by a clock signal with an adjustable duty cycle.

3. The microphone biasing circuit of claim 1, the resistance comprising:

a third diode and a fourth diode, each connected between the second node and the fourth node, the third diode and the fourth diode being connected antiparallel with one another, the fourth node having the second DC bias voltage that is coupled to the second node via the third diode and the fourth diode.

4. The microphone biasing circuit of claim 3, wherein:

the third diode comprises a series connection of at least two third diodes; and the fourth diode comprises a series connection of at least two fourth diodes.

5. The microphone biasing circuit of claim 1, wherein the at least one element in the first feedback path is a capacitor configured to couple the alternating components of the output voltage at the third node to the second node.

6. The microphone biasing circuit of claim 1, wherein the at least one element in the first feedback path is a capacitor and capacitance multiplier, the capacitor and capacitance multiplier in combination being configured to couple the alternating components of the output voltage at the third node to the second node.

7. The microphone biasing circuit of claim 1, further comprising:

a capacitor connected between the second terminal of the microphone and a ground voltage.

8. The microphone biasing circuit of claim 1, further comprising:

a charge pump circuit configured to provide the first DC bias voltage; and a fifth diode and a sixth diode, each connected between the charge pump circuit and the second terminal of the microphone, the fifth diode and the sixth diode being connected antiparallel with one another.

9. The microphone biasing circuit of claim 1, wherein the first amplifier is configured to operate as a voltage buffer having unity gain.

10. The microphone biasing circuit of claim 1, further comprising:

a capacitor connected in parallel with the resistance between the second node and the fourth node.

11. The microphone biasing circuit of claim 1, the offset correction circuit comprising:

one of an integrator circuit and a proportional-integrator circuit.

12. The microphone biasing circuit of claim 1, the offset correction circuit comprising:

a low pass filter circuit.

13. The microphone biasing circuit of claim 1, the offset correction circuit comprising:

a digital filter arranged in the second feedback path configured to adjust the DC offset of the sensed voltage at the first node to have the predetermined magnitude;

an analog-to-digital converter arranged in the second feedback path between the third node and an input of the digital filter; and a digital-to-analog converter arranged in the second feedback path between an output of the digital filter and the fourth node.

14. The microphone biasing circuit of claim 13, the offset correction circuit comprising:

an anti-aliasing filter arranged in the second feedback path between the third node and the analog-to-digital converter.

15. The microphone biasing circuit of claim 13, wherein the digital filter includes an integration path and a proportional path.

16. The microphone biasing circuit of claim 1, further comprising:

a capacitor connected in parallel with the first diode and the second diode between the first node and the second node.

17. The microphone biasing circuit of claim 1, wherein the microphone comprises a capacitive transducer.

18. The microphone biasing circuit of claim 1, wherein the microphone comprises a microelectromechanical systems (MEMS) transducer.

19. A microphone biasing circuit comprising:

a microphone having a first terminal connected to a first node and a second terminal connected to a first DC bias voltage, the microphone being configured to provide a sensed voltage at the first node in response to sound;

a first diode and a second diode, each connected between the first node and a second node, the first diode and the second diode being connected antiparallel with one another, the second node having a second DC bias voltage that is coupled to the first node via the first diode and the second diode;

a first amplifier having an input connected to the first node and an output connected to a third node, the first amplifier being configured to provide an output voltage to the third node based on the sensed voltage at the first node;

a resistance connected between the second node and a fourth node, the resistance comprising at least one of:

a switch connected in series with a resistor between the second node and the fourth node, the switch being operated by a clock signal with an adjustable duty cycle; and a third diode and a fourth diode, each connected between the second node and the fourth node, the third diode and the fourth diode being connected antiparallel with one another, the fourth node having the second DC bias voltage that is coupled to the second node via the third diode and the fourth diode; and a first feedback path connected from the third node to the second node, the first feedback path comprising:

at least one element arranged in the first feedback path and configured to couple alternating components of the output voltage at the third node to the second node.

20. A microphone biasing circuit comprising:

a microphone having a first terminal connected to a first node and a second terminal connected to a first DC bias voltage, the microphone being configured to provide a sensed voltage at the first node in response to sound;

a first diode and a second diode, each connected between the first node and a second node, the first diode and the second diode being connected antiparallel with one another, the second node having a second DC bias voltage that is coupled to the first node via the first diode and the second diode;

a first amplifier having an input connected to the first node and an output connected to a third node, the first amplifier being configured to provide an output voltage to the third node based on the sensed voltage at the first node;

a resistance connected between the second node and a fourth node;

a capacitor connected in parallel with the resistance between the second node and the fourth node; and a first feedback path connected from the third node to the second node, the first feedback path comprising:

at least one element arranged in the first feedback path and configured to couple alternating components of the output voltage at the third node to the second node.

* * * * *